US006190185B1

(12) United States Patent
Daoud

(10) Patent No.: US 6,190,185 B1
(45) Date of Patent: Feb. 20, 2001

(54) CONNECTOR WITH SEALING COVER

(75) Inventor: Bassel H. Daoud, Parsippany, NJ (US)

(73) Assignee: Avaya Technology Corp., Miami Lakes, FL (US)

( * ) Notice: Under 35 U.S.C. 154(b), the term of this patent shall be extended for 0 days.

(21) Appl. No.: 09/390,394

(22) Filed: Sep. 3, 1999

(51) Int. Cl.[7] ..... H01R 13/44
(52) U.S. Cl. ..... 439/135; 439/142
(58) Field of Search ..... 439/142, 135, 439/136, 367, 888, 138

(56) References Cited

U.S. PATENT DOCUMENTS 4,070,078 * 1/1978 Chrones ..... 439/142
4,700,995 * 10/1987 Kupferschmidt et al. ..... 439/142
5,726,392 * 3/1998 Farr et al. ..... 439/587

* cited by examiner

*Primary Examiner*—T. C. Patel
(74) *Attorney, Agent, or Firm*—David L. Davis

(57) ABSTRACT

A connector having integrally formed walls and a cover enclosing wire receiving ends of terminals. The connector has openings along an edge which have resilient grommets installed therein. Each of the grommets includes a central web which is slit to allow wires connected to the terminal ends to be moved laterally into the center of the grommet and be conformably received therein.

9 Claims, 3 Drawing Sheets

CONNECTOR WITH SEALING COVER

BACKGROUND OF THE INVENTION

This invention relates to a connector particularly suitable for use in a building entrance box and, more particularly, to such a connector having a sealing cover.

Where telephone wires enter a building, there is usually provided a building entrance box. The incoming wires, which are typically contained within one or more multi-wire cables, enter a splice chamber in the box, where they are connected to wires which go to a protector field, in a connector chamber of the box, providing protection against lightning, high voltage and high current, and then connections are made within the connector chamber to an output wire connector field. At the connector field, connections are made to wires which extend through the building to output jacks at various locations in the building. Accordingly, a connector is provided within the connector chamber.

When such a box is used in an outdoor application, moisture can enter the box through openings provided for the incoming cables. This moisture can pass from the splice chamber to the connector chamber and can condense on the underside of the connector field, where it can short out terminals. To prevent such problems, in the past the underside of the connector field has been potted. This is a time consuming and costly procedure, requiring a large amount of potting material. It would therefore be desirable to provide a connector which protects the connector field from condensation, without requiring potting.

SUMMARY OF THE INVENTION

According to the present invention, there is provided a plurality of elongated conductive terminals each having first and second wire-receiving ends along a longitudinal axis of each terminal and a substantially planar insulative base holding the plurality of terminals in a parallel spaced array. The axes of the terminals are orthogonal to the base with the first ends of all of the terminals extending outwardly from a first side of the base and the second ends of all of the terminals extending outwardly from a second side of the base. An insulative wall extends from the first side of the base and surrounds the first ends of all of the terminals. The wall terminates in a distal edge which is further from the first side of the base than the first ends of all of the terminals. A cover is secured to the wall to enclose the first ends of all of the terminals. The cover has an opening to allow the passage therethrough of wires secured to the first ends of the terminals and the opening is conformable to snugly surround the wires passing therethrough.

In accordance with an aspect of this invention, the wall includes four segments arranged to define a rectangular periphery around the first ends of the terminals and the cover is formed integrally with one of the wall segments and has a substantially planar rectangular configuration matching the rectangular periphery defined by the wall segments.

In accordance with another aspect of this invention, the cover is connected to that wall segment by a living hinge joining a first edge of the cover and the distal edge of the one wall segment.

In accordance with a further aspect of this invention, another edge of the cover is formed with an indentation to define the opening.

In accordance with yet a further aspect of this invention, the connector further includes a grommet formed of resilient insulative material installed in the indentation.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
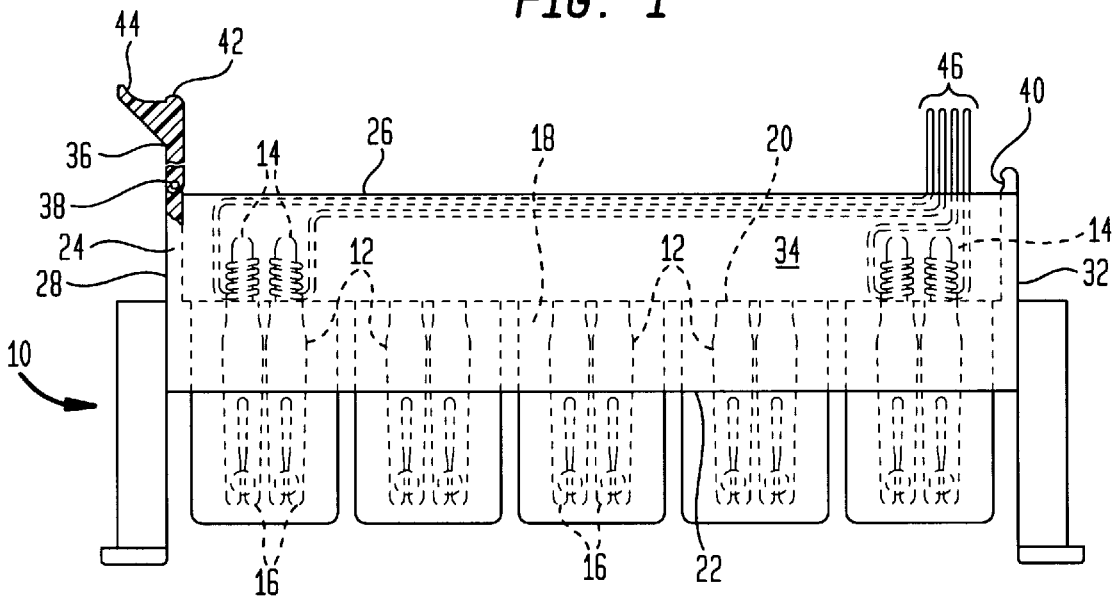
FIG. 1 is a side view, partially sectioned, of an illustrative embodiment of a connector constructed in accordance with the principles of this invention with the cover in an open position.

Referring to the drawings, shown therein is a connector constructed according to the principles of this invention and designated generally by the reference numeral 10. The connector 10 includes a plurality of elongated conductive terminals 12 each having a first wire receiving end 14 and a second wire receiving end 16. As shown, the first wire receiving end 14 is adapted for a wire wrap termination and the second wire receiving end 16 is adapted for an insulation displacement connection, but it is not intended that these types of connections be limiting. The connector 10 includes a substantially planar insulative base 18 which holds the terminals 12 in a parallel spaced array. When so held, the axes of the terminals 12 are orthogonal to the base 18, with all of the ends 14 extending outwardly from a first side 20 of the base 18 and all of the second ends 16 extending outwardly from a second side 22 of the base 18. Preferably, the terminals 12 are all identical in size and configuration and their ends 14 all extend an equal distance from the side 20.

Figure 2:
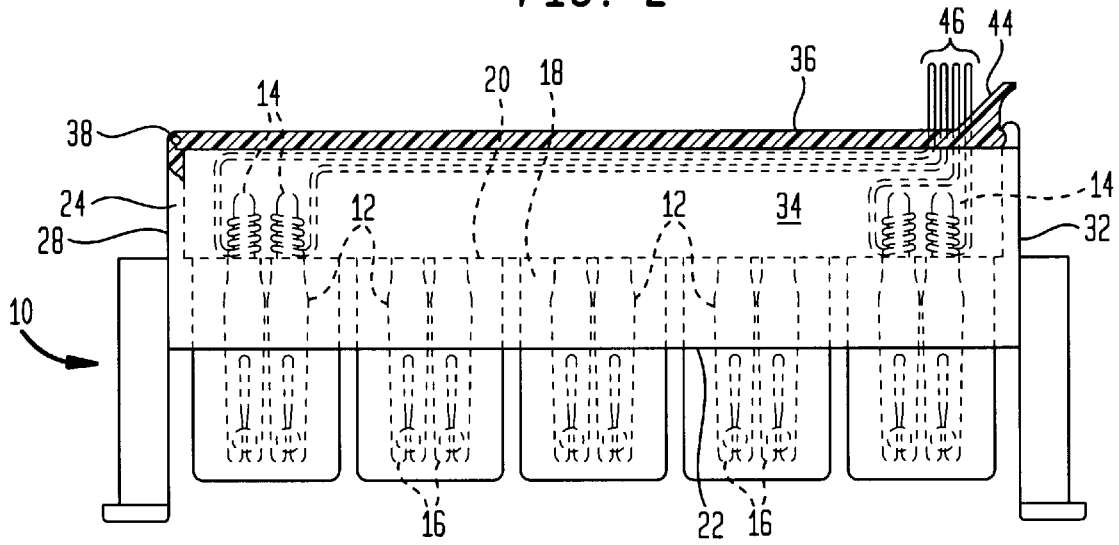
FIG. 2 is a view similar to FIG. 1 showing the cover in its closed position.

An insulative wall 24 extends from the side 20 of the base 18 and surrounds the first ends 14 of all of the terminals 12. The wall 24 terminates in a distal edge 26 which is further from the side 20 than the first ends 14 of all of the terminals 12, as best shown in FIGS. 1 and 2. Illustratively, the wall 24 is formed integrally with the base 18 and is made up of four segments 28, 30, 32, 34 which are arranged in a rectilinear pattern to define a rectangular periphery around the first ends 14 of the terminals 12. Illustratively, the wall 24 extends orthogonally to the side 20 of the base 18.

According to the present invention, the connector 10 includes a cover 36. The cover 36 is preferably formed integrally with the wall segment 28 and is connected to the wall segment 28 by a living hinge 38 joining a first edge of the cover 36 to the distal edge of the wall segment 28. The cover 36 has a substantially planar rectangular configuration matching the rectangular periphery defined by the wall segments 28, 30, 32, 34. Thus, the cover 36 is adapted to enclose the first ends 14 of all of the terminals 12. To maintain the cover 36 in its closed position, as shown in FIG. 2, the cover 36 and the wall segment 32 include complementary features. Illustratively, the wall segment 32 extends beyond the distal edges of the adjacent wall segments 30, 34 and in that extension is formed with an indentation 40 on its side facing the cover 36. Preferably, the indentation 40 is an elongated groove extending the length of the wall segment 32 and parallel to the side 20 of the base 18. Along its edge opposite the living hinge 38, the cover 36 is formed with a protrusion 42 which fits in the indentation 40. Thus, the cover 36 is snap fit into the wall segment 32 when the cover 36 is moved to its closed position, as viewed in FIG. 2. The cover 36 is further formed with a handle portion 44 adjacent the protrusion 42.

Figure 3:
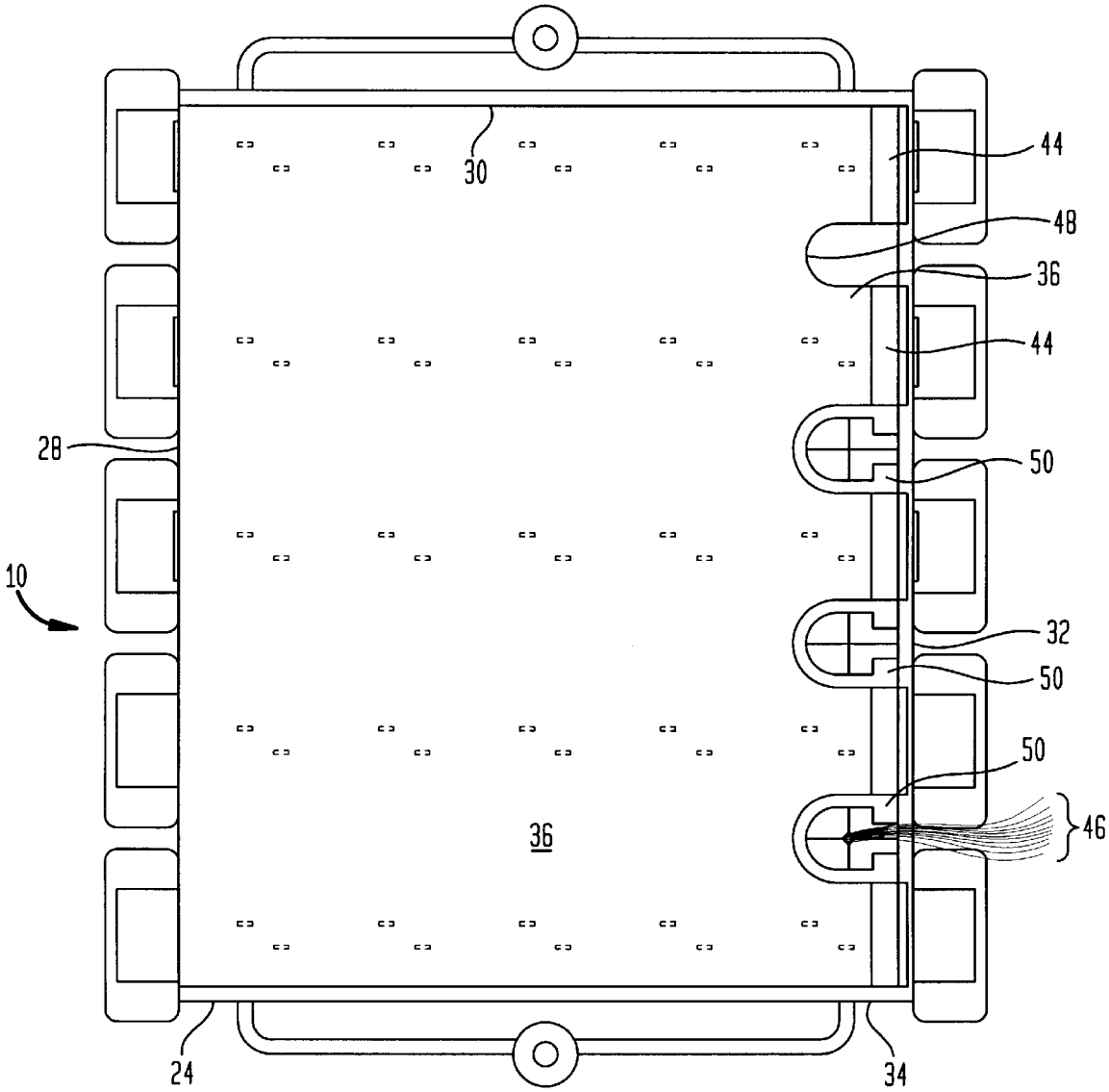
FIG. 3 is a top plan view of the connector shown in FIG. 2.
Figure 4:
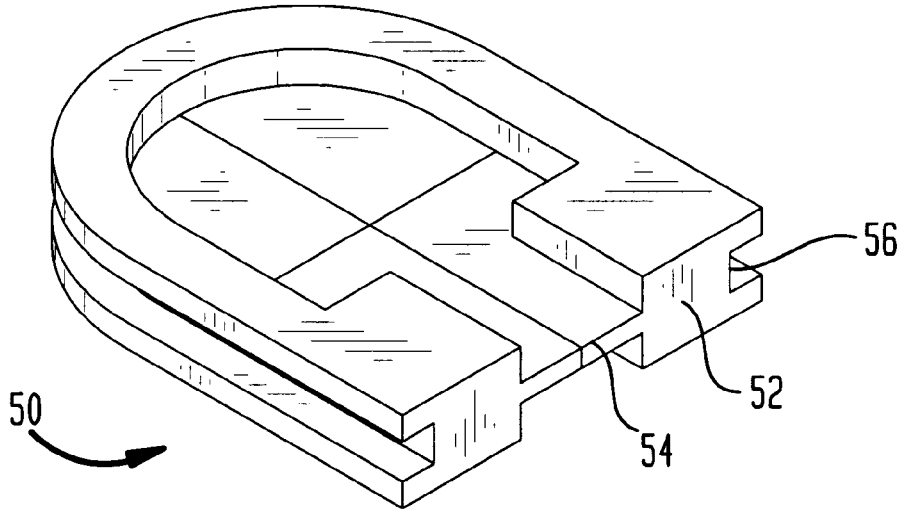
FIG. 4 is a perspective view of an illustrative grommet which may be utilized as part of the connector shown in FIGS. 1–3.

In order to allow wires 46 connected to the ends 14 of the terminals 12 to exit the connector 10 after the cover 36 is in its closed position, the cover 36 is provided with an opening to allow the wires 46 to pass therethrough, and the opening is conformable to snugly surround the wires 46. As shown, along its edge opposite the living hinge 38, the cover 36 is formed with an indentation 48. Illustratively, there are four such indentations, as shown in FIG. 3. Fitted in each such indentation 48 is a grommet 50, only three of which are shown in FIG. 3. The grommet 50 is formed from resilient insulative material and includes an outer thickened region 52 and a central web 54. The thickened region 52 of the grommet 50 is bifurcated along its periphery, as shown at 56, so that it can be installed in the indentation 48. The central web 54 is slit in a cross shape, as shown in FIGS. 3 and 4. Accordingly, after the wires 46 are connected to the terminal ends 14, the wires 46 may be moved laterally into the slit of the central web 54 and the cover 36 may then be moved to its closed position. The central web 54 of the grommet 50 provides a snug conformable fit around the wires 46. Accordingly, a relatively tight seal is provided for the first side 20 of the base 18 of the connector 10.

Accordingly, there has been disclosed an improved connector having a sealing cover. While an illustrative embodiment of the present invention has been disclosed herein, it is understood that various adaptations and modifications to the disclosed embodiment are possible and it is intended that this invention be limited only by the scope of the appended claims.

What is claimed is:

1. A connector comprising:

a plurality of elongated conductive terminals each having first and second wire-receiving ends along a longitudinal axis of said each terminal;

a substantially planar insulative base holding said plurality of terminals in a parallel spaced array with the axes of the terminals orthogonal to the base and with the first ends of all of the terminals extending outwardly from a first side of the base and the second ends of all of the terminals extending outwardly from a second side of the base;

an insulative wall extending from the first side of the base and surrounding the first ends of all of the terminals, the wall terminating in a distal edge which is further from the first side of the base than the first ends of all of the terminals; and a cover secured to the wall to enclose the first ends of all of the terminals, wherein the cover has an opening to allow the passage therethrough of wires secured to the first ends of the terminals and the opening is conformable to snugly surround the wires passing therethrough.

2. The connector according to claim 1 wherein:

the wall includes four segments arranged to define a rectangular periphery around the first ends of the terminals; and the cover is formed integrally with one of said wall segments and has a substantially planar rectangular configuration matching the rectangular periphery defined by the wall segments.

3. The connector according to claim 2 wherein:

the cover is connected to said one wall segment by a living hinge joining a first edge of the cover and the distal edge of said one wall segment.

4. The cover according to claim 3 wherein:

the cover and the wall segment opposite said one wall segment include complementary features to retain the cover substantially parallel to the base.

5. The connector according to claim 4 wherein:

a second edge of the cover is formed with an indentation to define the opening.

6. The connector according to claim 5 further comprising:

a grommet formed of resilient insulative material installed in the indentation.

7. The connector according to claim 6 wherein:

the grommet is slit to allow the lateral passage of wires into its interior.

8. The connector according to claim 7 wherein the grommet includes:

an outer thickened region bifurcated along its periphery for installation in the cover indentation; and a central web, the central web being slit in a cross shape to receive the wires therein.

9. The connector according to claim 4 wherein:

said opposite wall segment is formed with an indentation on its side facing said cover; and the edge of said cover opposite said first edge is formed with a protrusion to fit in said opposite wall segment indentation.

* * * * *